United States Patent [19]

Killy

[11] 4,361,266

[45] Nov. 30, 1982

[54] COATED PAPERBOARD FOOD PACKAGE

[75] Inventor: Earl J. Killy, Monroe, La.

[73] Assignee: Manville Service Corporation, Denver, Colo.

[21] Appl. No.: 262,884

[22] Filed: May 13, 1981

[51] Int. Cl.[3] ..... B65D 5/26; B65D 43/02

[52] U.S. Cl. ..... 229/32; 229/31 R; 229/31 FS; 229/34 R; 229/45 R; 206/620

[58] Field of Search ..... 229/31 R, 31 FS, 32, 229/34 R, 43, 45 R; 206/602, 604, 620, 621, 626

[56] References Cited

U.S. PATENT DOCUMENTS

| | | | |
|---|---|---|---|
| 1,437,274 | 11/1922 | Smith | 229/32 |
| 2,768,776 | 10/1956 | Weiss | 229/34 R |
| 2,779,526 | 1/1957 | Vogt | 229/34 R |
| 2,862,425 | 12/1958 | Suraim | 229/34 R |
| 2,865,549 | 12/1958 | Inman | 229/45 |
| 3,236,434 | 2/1966 | Taddeau | 229/31 R |
| 3,545,665 | 12/1970 | Nimaroff | 229/31 FS |
| 3,572,576 | 3/1971 | Foster | 229/31 FS |
| 3,591,071 | 7/1971 | Rosenberg | 206/626 |
| 3,967,774 | 7/1976 | Querner | 206/620 |
| 3,987,957 | 10/1976 | Johnson | 229/34 R |

*Primary Examiner*—Herbert F. Ross

*Attorney, Agent, or Firm*—Ronald M. Halvorsen; John D. Lister

[57] ABSTRACT

An improved coated paperboard tray and lid are disclosed having novel features which allow the lid to be adhesively secured to the tray and subsequently removed from the tray without destroying the integrity of the tray. The novel feature comprises a plurality of full and half gussets being formed in the corners of the tray and further comprises a plurality of glue tabs being formed on the full gusset. A cut-score line is formed between the lid glue tab and the full gusset which is positioned in juxtaposition to matching tear-off portions in at least two of the lid side panels.

3 Claims, 6 Drawing Figures

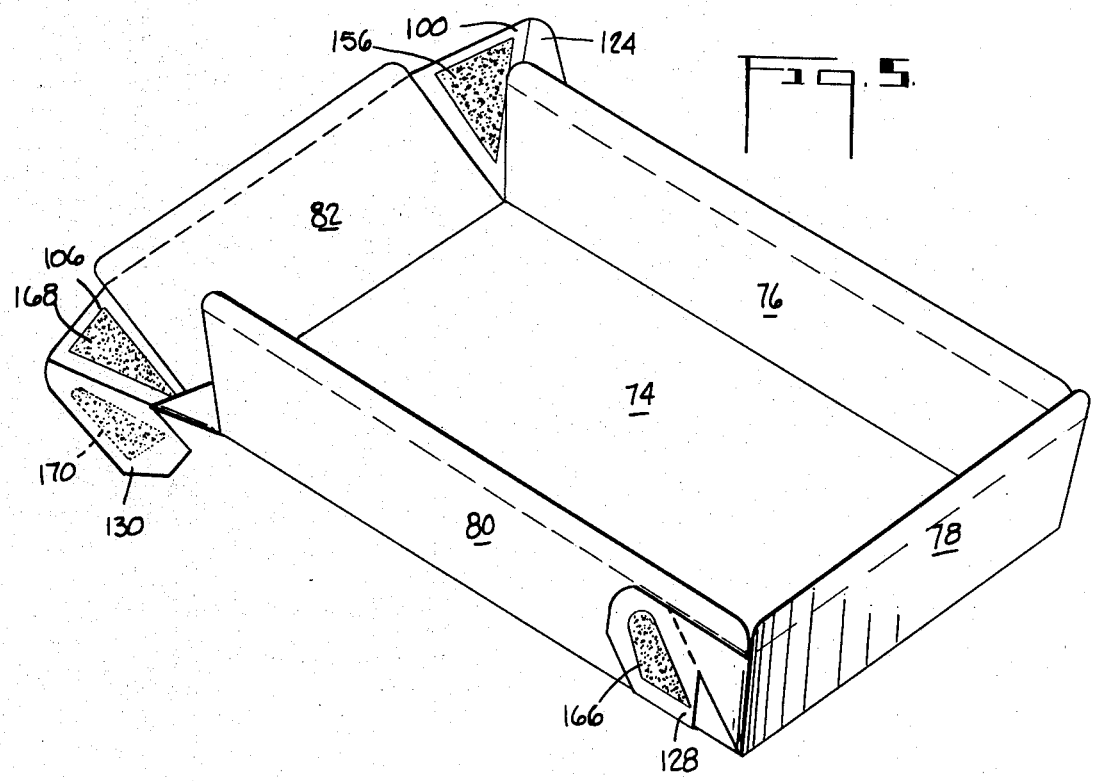
Fig. 5.
Fig. 6.
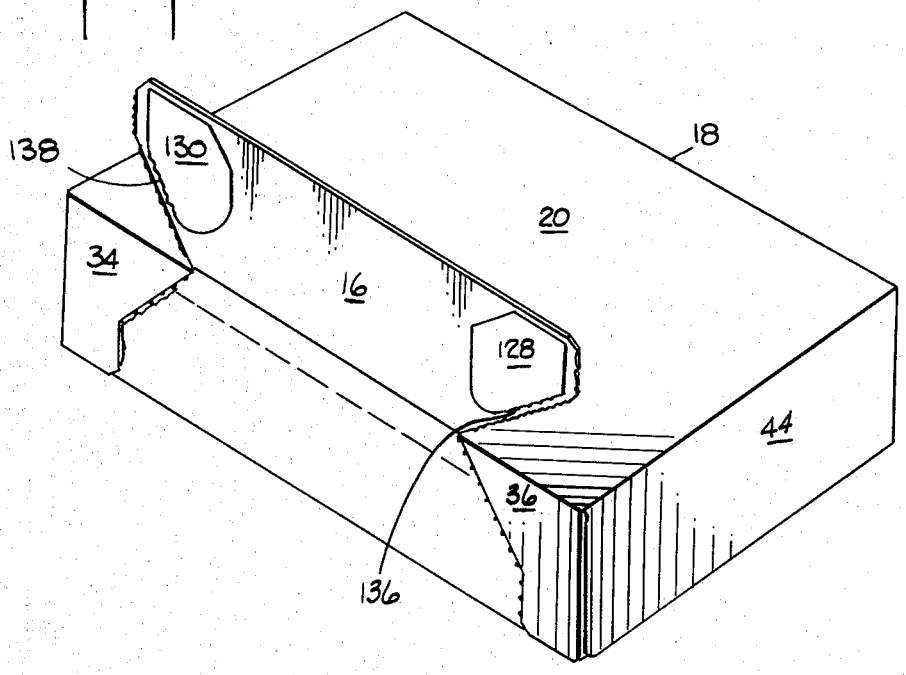

COATED PAPERBOARD FOOD PACKAGE

BACKGROUND OF THE INVENTION

This invention relates generally to packaging and more specifically to an improved coated paperboard food package of the type comprising a bottom tray and a top lid which may be removed from the tray as desired by the user.

It is known in the art of food packaging to provide a bottom paperboard tray coated with a suitable coating for purposes of placing advertising on the coating and also to have a matching top lid positioned over the filled tray. It is also known in the art to provide tear-off portions on the top lid of a frozen food package so that the contents of the package may be removed by releasing the tear-off portion which forms a major portion of the lid.

Such prior art frozen food cartons have been developed as paperboard packaging becomes more extensive in the food field. Many variations of paperboard packages are coming in style wherever it is desired to use the paperboard package for cooking the final product consumed by the user. For example, it may be desirous to provide a paperboard package having a plurality of bags of cake mix and frosting mix contained within the package for sale to a customer. The cake mix would then be mixed in the paperboard package and would be baked in an oven after which would be applied the frosting mix. In cases such as this, it would be desirable to have a paperboard tray and paperboard lid that would be severable from each other without destroying the integrity of either the lid or the tray using new and novel opening and tear-off features.

SUMMARY OF THE INVENTION

Accordingly, it is desirous to provide by the subject invention a new and novel coated paperboard food package which may be used in various ways by the ultimate consumer without totally destroying the integrity of the package and especially the integrity of the lid contained over the paperboard tray. The novel features of the Applicant's invention allow the paperboard lid to be adhesively secured to the underneath tray and subsequently removed from the tray by the use of a plurality of novel glue tabs formed on the tray structure. The tray proper comprises a plurality of full and half gussets which are formed in the corners of the tray and further comprises a cut-score line being formed between the lid glue tab and the full gusset which is positioned in juxtaposition to matching tear-off portions in at least two of the lid side panels. The lid is adhesively secured to the underneath tray at the tray glue tabs which then may be easily removed whenever a minor tear-out portion, formed on the top lid, is removed.

Accordingly, it is an object and advantage of the invention to provide an improved coated paperboard tray production blank having novel full and half corner gussets utilized in combination with tear-off type glue tabs which are glued to the matching lid which is ultimately positioned over the paperboard tray whenever the tray is erected.

Another object and advantage of the invention is to provide an improved coated paperboard lid production blank having a plurality of tear-out and non-tear-out portions which are used in combination with juxtaposition glue tabs formed on a mating tray whenever the complete package is formed and erected after having been filled with a consumable product.

Still yet another object and advantage of the invention is to provide an improved coated paperboard food package which comprises a novel paperboard tray and a novel paperboard lid which are adhesively secured together in a novel manner so that the lid may be removed from the tray without destroying the total integrity of the lid and the bottom tray.

These and other objects and advantages of the invention will become apparent from a review of the drawings attached herewith and from a reading of the description of the preferred embodiment.

BRIEF DESCRIPTION OF THE DRAWINGS

FIG. 5 is a perspective view of the Applicant's novel paperboard tray showing the right side of the tray having the plurality of full and half gussets folded and adhesively secured to the adjacent side panels and further showing the left side of the Applicant's tray in a position prior to being folded and adhesively secured as is shown in the right side of the drawing; and FIG. 6 is a perspective view similar to FIG. 4 and FIG. 1 of the drawing showing the Applicant's new and novel lid positioned over the Applicant's new and novel tray and further showing the left side of the lid having its tear-out portion being torn upwardly and showing how the glue tabs formed on the underneath tray have been severed from the tray to allow the lid to be removed from the tray keeping the lid intact as well as the tray intact.

DESCRIPTION OF THE PREFERRED EMBODIMENT

Figure 1:
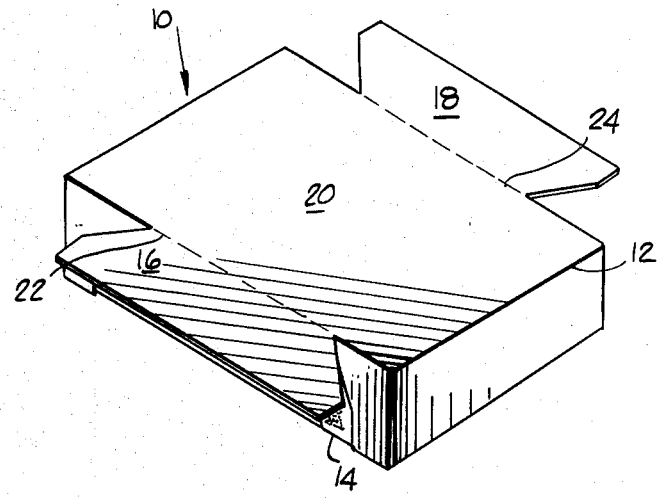
FIG. 1 is a perspective view of the Applicant's completed paperboard food package showing a pair of tear-out portions removed from the upper lid to allow the lid to be removed from the lower tray.

Referring now to the drawings in general and in particular to FIG. 1 of the drawing, there is shown the Applicant's coated paperboard food package generally by the numeral 10 which comprises an upper lid 12 positioned over a previously formed lower tray 14 and having a pair of tear-out portions 16 and 18 hingedly attached to a top panel 20 by means of parallel score lines 22 and 24.

Figure 2:
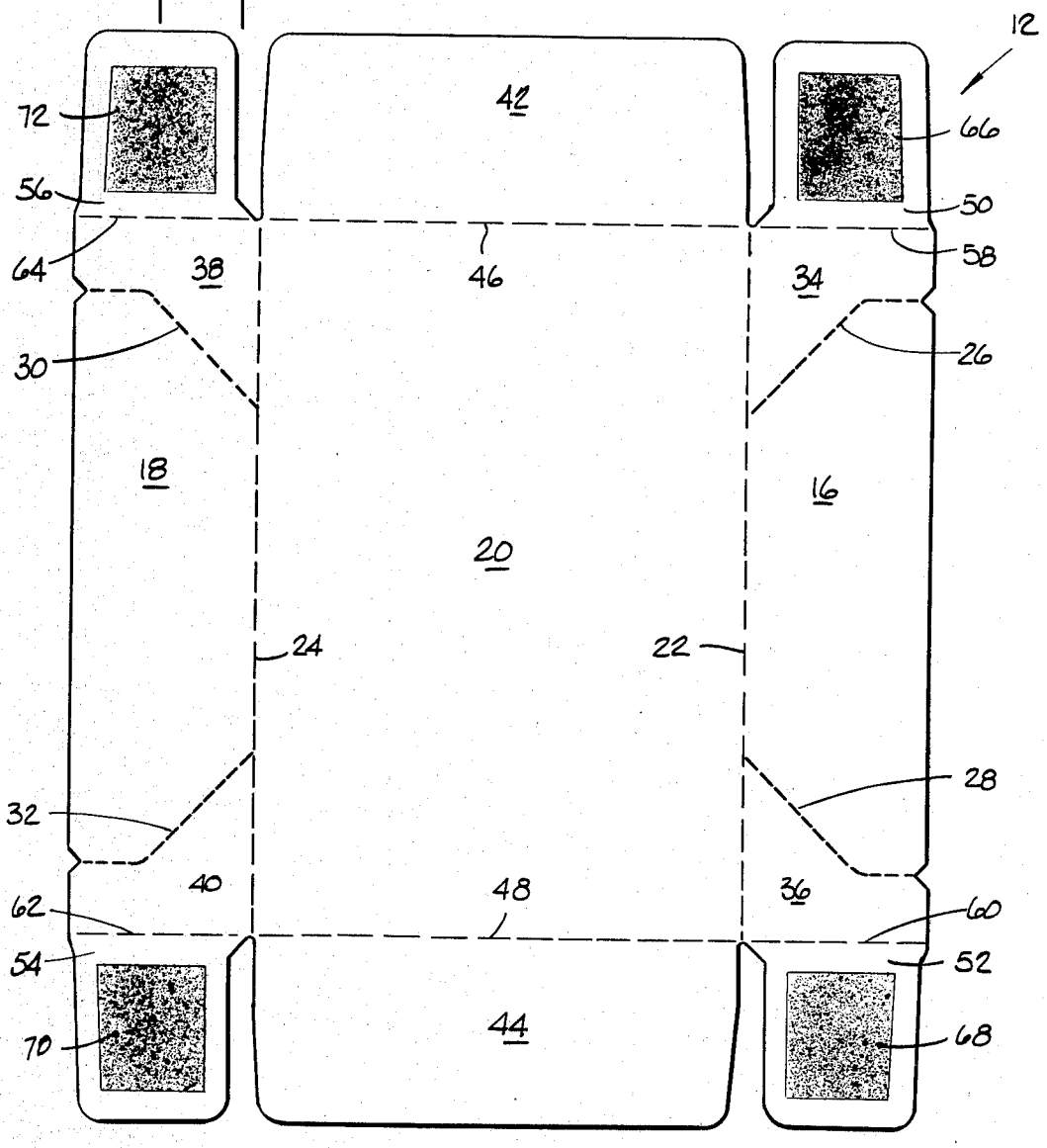
FIG. 2 is a plan view of the production blank for the novel paperboard lid shown in FIG. 1 of the drawing.

Referring now to FIG. 2 of the drawing, there is shown a plan view of the outside of the lid 12 showing its basic construction. As has been beforementioned, the top panel 20 of the lid 12 has formed on each side thereof matching tear-out portions 16 and 18 by means of the score lines 22 and 24. The tear-out portions 16 and 18 are formed by means of a pair of cut-score lines 26, 28, 30 and 32. By the use of the cut-score lines, the tear-out portions 16 and 18 may be severed from a pair of non-tear-out portions 34, 36, 38 and 40. It can be seen, for example, that the tear-out portion 16 may be severed from the non-tear-out portion 34 and 36 by means of the cut-score line 26 and 28 leaving the tear-out portion 16 being hingedly attached to the top panel 20 by means of the score line 22. In a like manner, the tear-out portion 18 may be severed from its adjacent non-tear-out portions 38 and 40 by means of the cut-score lines 30 and 32 leaving the tear-out portion 18 hingedly attached to the top panel 20 by means of the score line 24. The use of the non-tear-out portions 34, 36, 38 and 40 will be described more fully hereinafter when referring to the novel glue tabs formed on the tray and how the glue tabs are utilized to glue the tray to the lid. A pair of side panels 42 and 44 are hingedly attached to the top panel 20 by means of the score lines 46 and 48 thereby forming the remaining sides of the lid structure. Each non-tear-out portion 34, 36, 38 and 40 has formed on the end thereof a glue tab formed thereby in conjunction with a score line. For example, the non-tear-out portion 34 has formed on one side thereof a glue tab 50 by means of the score line 58 while the non-tear-out portion 36 has formed on one side thereof a glue tab 52 by means of the score line 60. In a similar, the non-tear-out portion 38 has formed on one side thereof a glue tab 56 by means of the score line 64 and the non-tear-out portion 40 has formed on the one side thereof a glue tab 54 by means of the score line 62.

Figure 3:
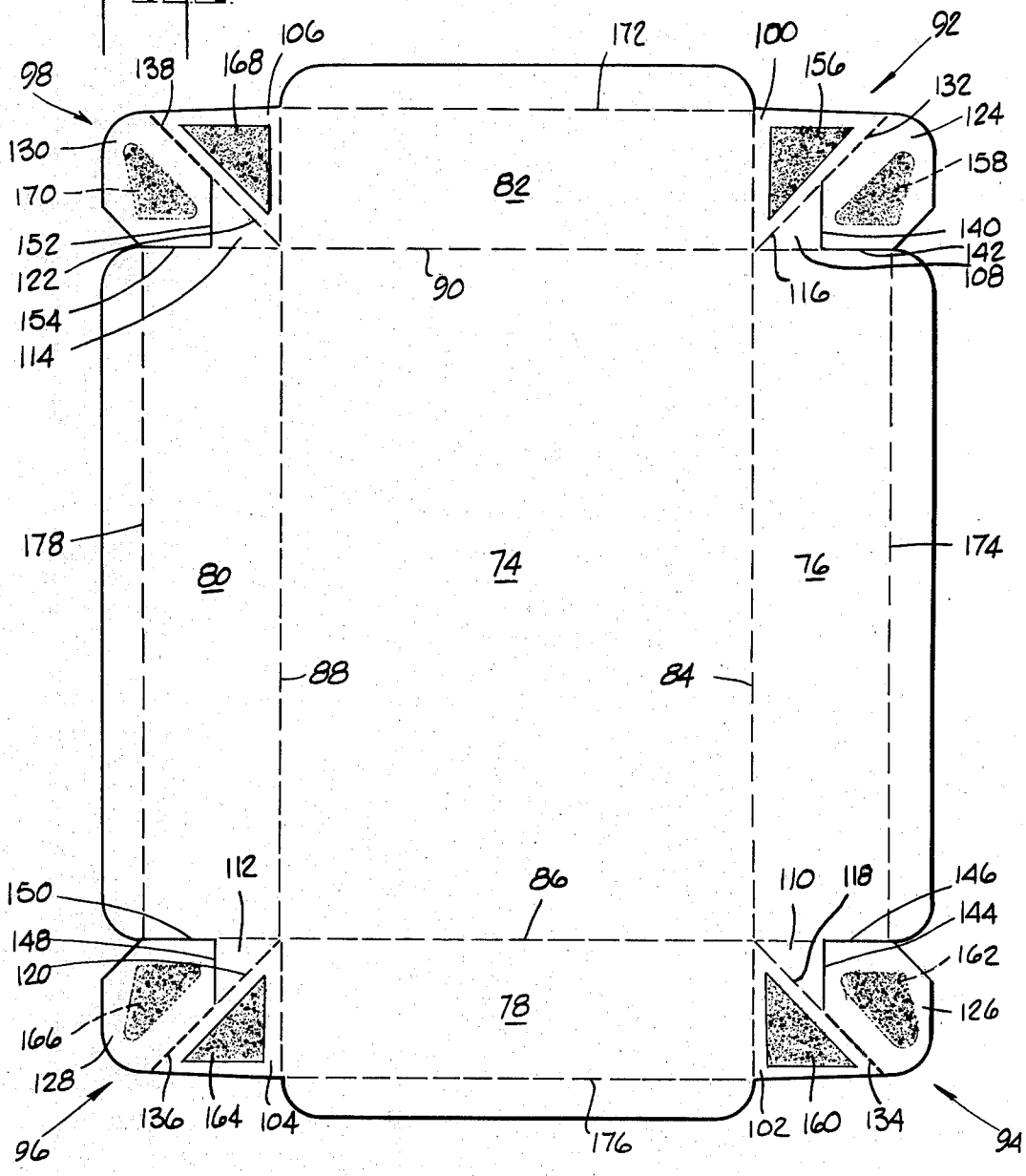
FIG. 3 is a plan view of the production blank for the novel paperboard tray which is positioned below the novel lid shown in FIG. 2 of the drawing whenever the lid and the tray are erected.

Each glue tab has formed thereon on the inside portion of the paperboard blank as shown in FIG. 2 of the drawing, a predetermined quantity of adhesive shown generally by the stippled area. For example, the glue tab 50 has a predetermined quantity of adhesive 66 while the glue tab 52 has a predetermined quantity of adhesive 68. In a similar means, the glue tab 54 has a predetermined quantity of adhesive 70 while the glue tab 56 has a predetermined quantity of adhesive 72. The respective glue tabs 50, 52, 54 and 56 are used then to glue the adjacent side panels together as is known in the art of forming paperboard lids. For example, the glue tab 50 would be used to adhesively secure the side panel 42 to the non-tear-out portion 34 while the glue tab 52 would be used to adhere the side panel 44 to the non-tear-out portion 36. In a similar manner, the glue tab 54 would be used to adhere the side panel 44 to the non-tear-out portion 40 and the glue tab 56 would be used to adhere the side panel 42 to the non-tear-out portion 38. When formed thusly, the production blank of FIG. 2 would be formed into a lid structure similar to that shown in FIG. 4 of the drawing which would be positioned over the bottom tray. Referring now to FIG. 3 of the drawing, there is shown the tray portion of the Applicant's paperboard food package which comprises a bottom panel 74 having hingedly attached thereto a plurality of side panels 76, 78, 80 and 82 which are hingedly attached thereto by means of the score lines 84, 86, 88 and 90. The respective adjacent side panels are hingedly attached to each other by corner gusset panels shown generally by the numerals 92, 94, 96 and 98. For example, the side panels 76 and 82 are hingedly attached to each other by a corner gusset panel 92 while the side panel 76 and the side panel 78 are hingedly attached to each other by corner gusset panel 94. In a similar manner, the side panel 78 and the side panel 80 are hingedly attached to each other by means of the corner gusset panel 96 and the side panel 80 and the side panel 82 are hingedly attached to each other by means of the corner gusset panel 98. Each corner gusset panel is formed by a full gusset and a half gusset hingedly attached together. For example, the corner gusset panel 92 is formed by a full gusset 100 and a half gusset 108 hingedly attached together by means of the score line 116. In a similar manner, the corner gusset panel 94 is formed with a full gusset 102 and a half gusset 110 hingedly attached together by means of the score line 118. On the opposite side of the production blank, the corner gusset panel 96 is formed with a full gasset 104 and a half gusset 112 hingedly attached together by means of the score line 120. And in a similar manner, the corner gusset panel 98 is formed with a full gusset 106 hingedly attached to a half gusset 114 by means of the score line 122. Each full gusset and half gusset are hingedly attached to their adjacent side panels by an extension of the respective score lines 84, 86, 88 or 90.

Each full gusset also has hingedly attached thereto a tray glue tab which is utilized in the manner to be described in more detail later. For example, the full gusset 100 has hingedly attached thereto a tray glue tab 124 by means of the cut-score line 132 while the full gusset 102 has hingedly attached thereto a tray glue tab 126 by means of the cut-score line 134. On the opposite side of the production blank, the full gusset 104 has hingedly attached thereto a tray glue tab 128 by means of the cut-score line 136. The full gusset 106 then has a tray glue tab 130 hingedly attached thereto by means of the cut-score line 138. The tray glue tabs are separated from the adjacent half gusset and the adjacent side panels by a plurality of die cuts. For example, the tray glue tab 124 is separated from the half gusset 108 by means of the die cut 140 and from the adjacent side panel 76 by means of the die cut 142. In a similar manner, the tray glue tab 126 is separated from the half gusset 110 by means of the die cut 144 and is separated from the adjacent side panel 76 by the die cut 146. On the opposite side of the production blank, the tray glue tab 128 is separated from the half gusset 112 by means of the die cut 148 and is also separated from the side panel 80 by means of the die cut 150. In a like manner, the half gusset 114 is separated from the tray glue tab 130 by means of the die cut 152 and is separated from the side panel 80 by means of the die cut 154.

Each full gusset and tray glue tab has formed thereon a predetermined quantity of adhesive which is formed on the inside of the tray in the case of the full gusset and is formed on the other side of the tray in the case of the tray glue tab. Adhesive applied to the inside of the tray is shown in FIG. 3 by a stippled area surrounded by a solid line while adhesive applied to the other side of the tray is shown by a stippled area surrounded by a dotted line. For example, the full gusset 100 has formed thereon a second adhesive means 156 on the inside of the tray production blank while the tray glue tab 124 has formed thereon a predetermined thid adhesive means 158 on the other side of the production blank. In a similar manner, the full gusset 102 has formed on the inside of the tray production blank a predetermined quantity of adhesive 160 while the tray glue tab 126 formed on the other side of the production blank as predetermined quantity of adhesive 162. In a like manner, on the other side of the production blank, the full gusset 104 has formed on the inside of the tray of the production blank a predetermined quantity of adhesive 164 while the tray glue tab 128 has formed on the other side of the tray production blank a predetermined quantity of adhesive 166. Similarly, the full gusset 106 has formed on the inside of the tray production blank a predetermined quantity of adhesive 168 while the tray glue tab 130 has formed on the other side of the tray production blank, a predetermined quantity of adhesive 170.

Each side panel has also formed around the upper portion thereof a score line for folding a portion of the side panel downwardly after the erected tray is filled in a filling operation if this feature is desired. For example, the side panel 76 has formed thereon a score line 174 which allows a portion of the side panel 76 to be folded to form a lip on that side of the panel. In a similar manner, the side panel 78 has formed thereon a score line 176 allowing a portion of the side panel 78 to be also folded downwardly. In a similar manner, the side panel 80 has formed thereon a score line 178 allowing the upper portion of the side panel 80 to be folded downwardly to form a lip around the side panel, if desired. The side panel 82 also has formed thereon a score line 172 allowing an upper portion of the side panel 82 to be folded downwardly to form a lip thereon. When formed thusly, it can be seen that the erected tray 14 may be formed having downwardly folded lips which are parallel to the bottom panel 74 to add further rigidity to the tray and also to serve as a means of preventing material from sloping over the upper portions of the side panel after the product contained in the tray has been baked or heated in an oven.

Figure 4:
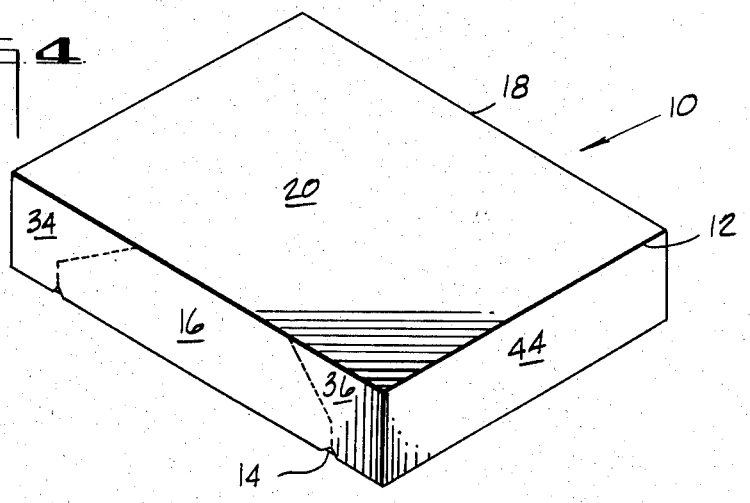
FIG. 4 is a perspective view showing the completed, closed paperboard food package comprising an upper lid adhesively secured at selected points to a lower tray.

Referring now to FIGS. 4, 5 and 6, there will be seen how the Applicant's new and novel lid and tray are juxtapositioned together after having been erected and after a predetermined quantity of food product is positioned in the tray and it is desirous to place the lid over the tray gluing the lid to the tray in predetermined positions. As has been previously mentioned, FIG. 4 is a perspective view showing the Applicant's paperboard food package 10 wherein the lid 12 has been positioned over the tray 14 previously formed and erected according to the structure shown in FIGS. 2 and 3 of the drawing. When formed thusly, it will be noted that the non-tear-off portions 16 and 18 have no adhesive positioned on those sections. The non-tear-out portions 34 and 36 as well as non-tear-out portions 38 and 40 have positioned beneath them the predetermined quantity of third adhesive means formed on the respective tray glue tabs which are positioned beneath the non-tear-out portions. This can be seen more clearly in FIG. 5 of the drawing which is a perspective view of the Applicant's new and novel tray showing on the right hand portion thereof the folded corner gusset panels in position so that the respective side panels are adhesively secured together. The left portion of FIG. 5 shows the respective side panels prior to being adhesively secured together so that the predetermined quantity of second adhesive means 156 and 168 formed on the respective full gussets 100 and 106 are adhered to their respective side panels 76 and 80. It can be seen also in FIG. 5 of the drawing how the respective glue tabs 130 and 128 are then exposed so that the exposed third adhesive means 166 and 170 would be in a position for adhesively securing the upper lid to the glue tab in the area of the non-tear-out portions 34 and 36 of the attached lid. By referring to FIG. 6 of the drawing, it can then be seen how the respective glue tabs 128 and 130 would then be glued to the side panel 16 of the lid and how they would be severed from their respective full gusset along their cut-score lines 136 and 138. When formed thusly, it will be seen that the tear-out portion 16 of the lid may be torn out from the bottom tray on one side of the carton and a similar tear-out portion may be torn out from the other side of the carton in order to allow the upper lid to be removed from the lower tray as shown in FIG. 1 of the drawing. Such a construction then allows the upper lid to retain its basic shape and also allows the lower tray to retain its basic shape so that the lower tray may be used as desired either with upturned upper edges on the tray side panels or downturned upper edges on the side panels as has been previously mentioned.

From the foregoing it can be seen that there has been provided by the subject invention an improved paperboard coated tray and lid forming an improved paperboard coated package which may be utilized for food products and which may be opened without destroying the integrity of either the lid or the tray. While many changes may be made in the arrangement of the various parts of the lid and the tray and the package structure, it should be noted that the structures shown were given by way of illustration only and the application is not to be limited to the exact manner shown.

Having described by invention, I claim:

1. An improved coated paperboard tray production blank, comprising:

(a) a bottom panel;

(b) a plurality of oppositely spaced side panels hingedly attached to the bottom panel;

(c) corner gusset panels hingedly attached to the side panels at each corner of the tray;

(1) each corner gusset panel comprising:

a. a full gusset hingedly attached to one of the side panels at each corner;

b. a half gusset hingedly attached to the adjacent side panel at each corner, the full and half gusset also being hingedly attached to each other along a diagonal scoreline;

c. a removable glue tab hingedly attached to each full gusset along an extension of the diagonal scoreline;

d. a predetermined amount of glue being applied to a first side of the tray on each glue tab; and e. a predetermined amount of glue being applied on each full gusset on a second side of the tray.

2. The paperboard tray production blank as defined in claim 1 further comprising each side panel having score lines formed around the upper portion of the side panel for folding a portion of the side panel downwardly after the erected tray is filled in a filling operation.

3. An improved coated paperboard food package comprising:

(a) a coated paperboard tray comprising:

(1) a bottom panel;

(2) a plurality of oppositely spaced side panels hingedly attached to the bottom panel;

(3) corner gusset panels hingedly attached to the side panels at each corner of the tray;

a. each corner gusset panel comprising:

[1] a full gusset hingedly attached to one of the side panels at each corner;

[2] a half gusset hingedly attached to adjacent side panels at each corner, the full and half gusset also being hingedly attached to each other along a diagonal scoreline; and

[3] A removable tray glue tab hingedly attached to each full gusset along an extension of the diagonal scoreline;

(b) an improved coated paperboard lid comprising:

(1) a top panel;

(2) a plurality of oppositely spaced side panels hingedly attached to the top panel;

(3) a pair of lid glue tabs hingedly attached to opposite ends of opposite side panels for gluing adjacent side panels together whenever the lid is erected; and (4) a pair of oppositely spaced cut-score lines formed in opposite side panels and forming a tear-out portion and two non-tear-out portions in at least two oppositely spaced side panels, the two non-tear-out portions being formed adjacent to the glue tabs hingedly attached to the opposite ends of opposite side panels; the cut-score lines being positioned in such a manner that the tear-out portions are positioned over the removable tray glue tabs formed on the paperboard tray positioned within the paperboard lid; and (c) first adhesive means formed on the lid glue tabs for adhesively securing the lid side panels into an erected lid;

(d) second adhesive means formed on each full gusset on one side of the paperboard tray for adhesively securing the full gusset to an oppositely positioned side panel; and (e) third adhesive means, formed on each tray glue tabs on the other side of the paperboard tray for adhesively securing the tray to the lid whenever the lid is positioned over the tray after the tray has been filled.

* * * * *